US007489327B2

(12) United States Patent
Kweon et al.

(10) Patent No.: US 7,489,327 B2
(45) Date of Patent: Feb. 10, 2009

(54) TONER ADSORPTION IMAGE FORMING APPARATUS

(75) Inventors: Soon Cheol Kweon, Seoul (KR); Kyu Ho Shin, Seoul (KR); Kae Dong Back, Yongin-si (KR); Chang Youl Moon, Suwon-si (KR); Ki Deok Bae, Yongin-si (KR); Won Kyoung Choi, Suwon-si (KR); Chang Seung Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 55 days.

(21) Appl. No.: 11/472,319

(22) Filed: Jun. 22, 2006

(65) Prior Publication Data

US 2007/0140740 A1 Jun. 21, 2007

(30) Foreign Application Priority Data

Dec. 16, 2005 (KR) ..... 10-2005-0124582

(51) Int. Cl.
*B41J 2/00* (2006.01)
*B41J 2/39* (2006.01)
*B41J 2/395* (2006.01)

(52) U.S. Cl. ..... 347/151; 347/141

(58) Field of Classification Search ..... 399/252, 399/264, 289; 347/141, 151, 158
See application file for complete search history.

(56) References Cited

U.S. PATENT DOCUMENTS

| | | | | |
|---|---|---|---|---|
| 5,247,317 | A * | 9/1993 | Corver et al. | 347/158 |
| 5,745,144 | A * | 4/1998 | Christy | 347/151 |
| 6,184,911 | B1 * | 2/2001 | Tombs | 347/141 X |
| 6,618,065 | B2 * | 9/2003 | Koga et al. | 347/141 |
| 6,795,101 | B2 * | 9/2004 | Van Der Meer et al. | 347/141 X |
| 7,071,958 | B2 * | 7/2006 | Liaw et al. | 347/141 X |

FOREIGN PATENT DOCUMENTS

| | | | |
|---|---|---|---|
| JP | 5-27761 | U | 4/1993 |
| JP | 6-206340 | A | 7/1994 |
| JP | 7-333974 | A | 12/1995 |
| JP | 10-305610 | A | 11/1998 |

* cited by examiner

*Primary Examiner*—Sandra L Brase
(74) *Attorney, Agent, or Firm*—Sughrue Mion, PLLC

(57) ABSTRACT

An image forming apparatus that may be easily and inexpensively manufactured is provided. The image forming apparatus includes: a toner supply unit; an image forming element to which toner is adsorbed from the toner supply unit; an image developing unit disposed on an outer side of the image forming element, wherein said image developing unit selectively separates from the image forming element at least a part of the toner adsorbed to the image forming element in order to develop an image on the image forming element; and a toner return unit which returns the toner separated from the image forming element by the image developing unit to the toner supply unit.

15 Claims, 17 Drawing Sheets

TONER ADSORPTION IMAGE FORMING APPARATUS

CROSS-REFERENCE TO RELATED APPLICATIONS

This application claims priority from Korean Patent Application No. 10-2005-0124582, filed on Dec. 16, 2005, in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus capable of being simple to manufacture or repair and reducing cost.

2. Description of the Related Art

FIG. 1 is a side view illustrating a structure of an image forming apparatus using a related ring conductor, FIG. 2 is a schematic perspective view illustrating a related image forming element according to a related art, and FIG. 3 is an enlarged cross-sectional view illustrating a portion of the circumferential wall of the image forming element according to the related art. The image forming element shown in FIGS. 2 and 3 is disclosed in U.S. Pat. No. 6,014,157 by reference.

Referring to FIGS. 1 through 3, the related image forming apparatus includes a toner supply unit 40, an image forming element 10, a magnetic cutter 50 separating a part of toner 1 adsorbed to the image forming element 10, and a toner return unit 60 which returns the toner 1 separated by the magnetic cutter 50 to the toner supply unit 40. The toner supply unit 40 supplies the toner by using a toner supply roller 42 from a toner storage 41. The image forming element 10 includes an image drum 12 and a plurality of ring electrodes 14 disposed on the image drum 12. Also, a control unit 16 is installed inside of the image drum to individually apply a voltage. The magnetic cutter 50 capable of separating the toner 1 adsorbed to the image forming element 10 is provided outside of the image drum 12.

When a voltage is not applied to the ring electrodes 14, the magnetic cutter 50 may separate the toner 1 adsorbed to the image forming element 10. However, when a voltage is applied to the ring electrodes 14, the toner 1 is not returned to the toner supply unit 40 by the magnetic cutter 50 and is transferred to an image transfer unit 70. The toner 1 transferred to the image transfer unit 70 is transferred to a printing paper and the printing paper is heated, thereby fixing the toner 1 to the printing paper.

However, there are problems of being difficult and very costly to manufacture or repair the image forming element 10. For example, to manufacture the related image forming element 10, grooves are cut into the outer circumferential surface of the drum body to have a pitch of approximately 40 μm and a width of approximately 20 μm, in which a conductive material is filled, and a hole is formed on the control unit and ring electrodes to electrically connect them. As a result, printers made using the related image forming method and apparatus have a high cost making popular acceptance for such printers difficult to achieve.

SUMMARY OF THE INVENTION

An aspect of the present invention provides an image drum which can be easily fabricated and can enable an excellent quality printing, and a method of manufacturing the same.

An aspect of the present invention also provides an image drum which can be rapidly and easily fabricated, is advantageous for mass production, and can reduce a manufacturing cost, and a method of manufacturing the same.

An aspect of the present invention also provides an image forming apparatus capable of reducing voltage consumption.

According to an aspect of the present invention, there is provided an image forming apparatus including: a toner supply unit; an image forming element to which toner is adsorbed from the toner supply unit; an image developing unit disposed on an outer side of the image forming element, wherein said image developing unit selectively separates from the image forming element at least a part of the toner adsorbed to the image forming element in order to develop an image on the image forming element; and a toner return unit which returns the toner separated from the image forming element by the image developing unit to the toner supply unit. The image developing unit includes a control unit including a plurality of electrodes, each of the electrodes disposed to be separated longitudinally in relation to the image forming element. In this case, a plurality of the control units may be provided to be vertically stacked. When there is the plurality of the control units, the electrodes of each of the plurality of the control units may individually apply a voltage and the same voltage may be applied to one or more of the electrodes of each of the plurality of the control units.

Also, the toner adsorbed to the image forming element may be separated by using a magnetic force of a magnet formed to have a magnetic force greater than a magnetic force that adsorbs the toner, together with an electrostatic force made by applying a voltage to the electrodes of the control unit. An initiative attraction which separates the toner adsorbed to the image forming element may be provided by using a magnetic force of an auxiliary magnet formed to have a magnetic force smaller than the magnetic force that adsorbs the toner before the voltage is applied to the electrodes of the control unit.

As described above, the control unit, including the electrodes, separates the toner adsorbed to the image forming element and may be formed separate from the image forming element and may be installed outside of the image forming element, thereby simplifying a process of manufacturing the image forming element and the entire manufacturing process, and preventing a decrease in productivity or a rise in cost.

BRIEF DESCRIPTION OF THE DRAWINGS

The above and/or other aspects of the present invention will become apparent and more readily appreciated from the following detailed description, taken in conjunction with the accompanying drawings of which.

DETAILED DESCRIPTION OF THE INVENTION

Figure 1:
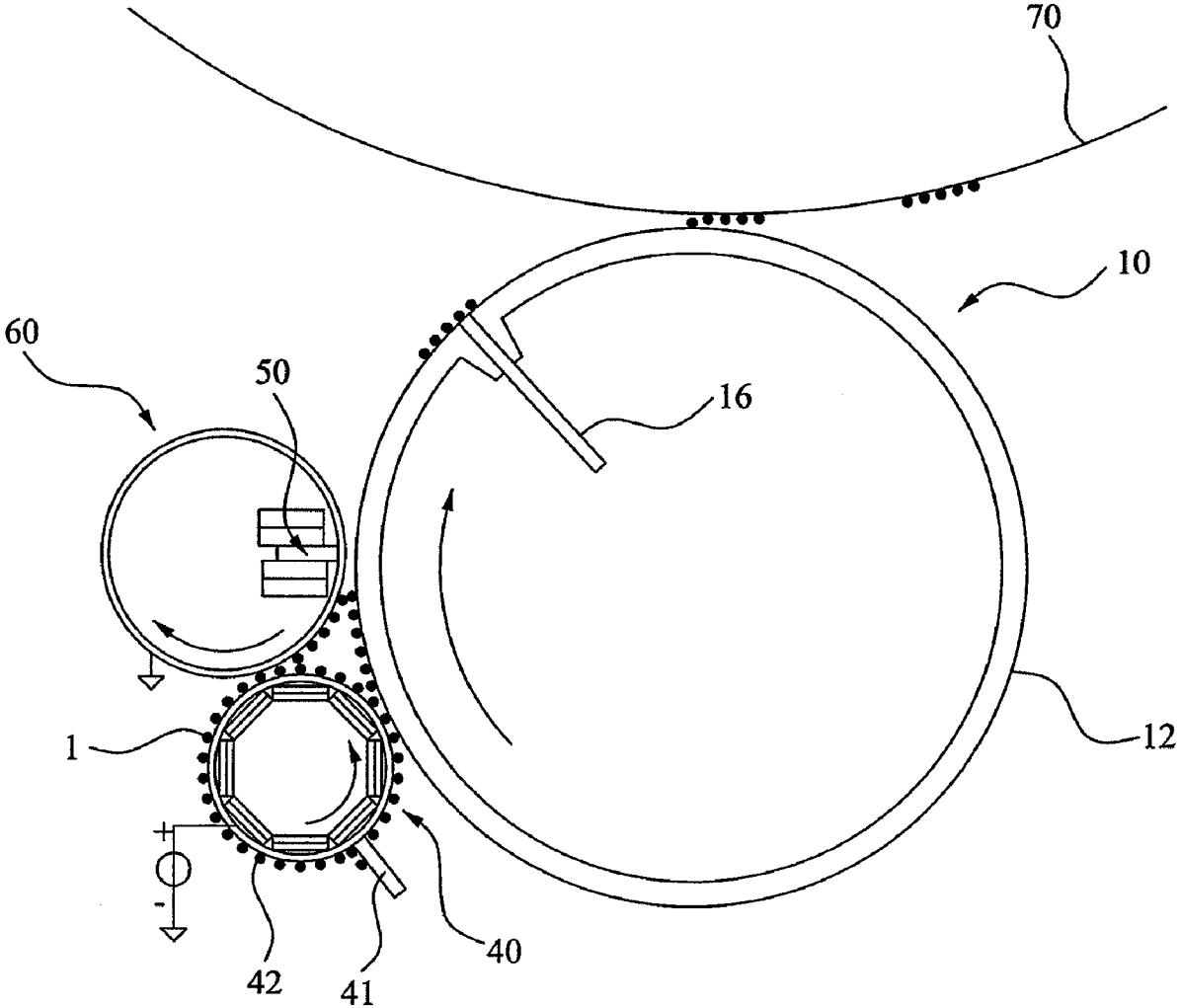
FIG.1 (RELATED ART)
FIG. 1 is a side view illustrating a structure of an image forming apparatus using a related ring conductor.

Reference will now be made in detail to the exemplary embodiments of the present invention, examples of which are illustrated in the accompanying drawings, wherein reference numerals of elements are used consistently throughout this specification. The exemplary embodiments are described below to explain the present invention by referring to the figures.

Figure 4:
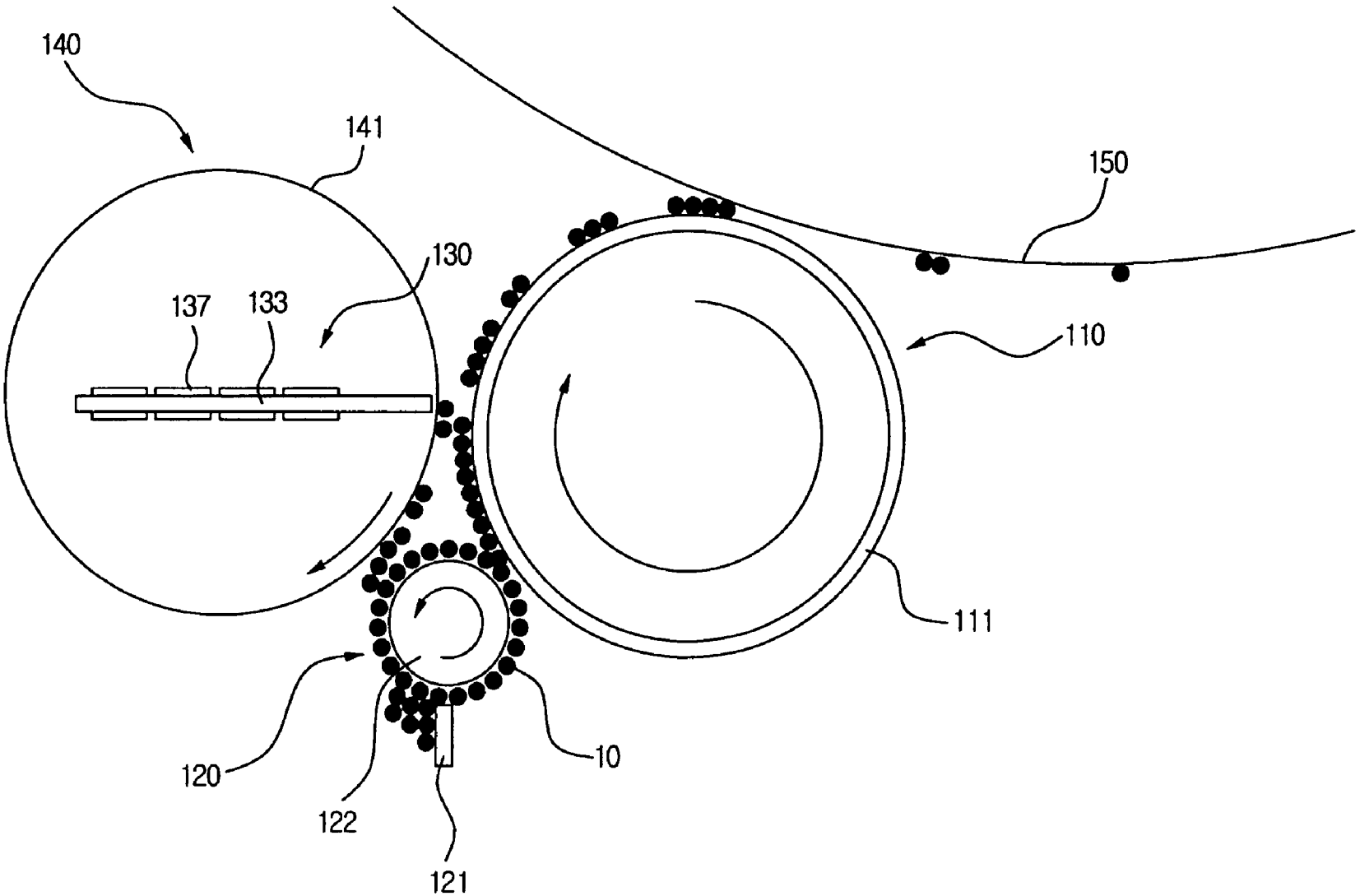
FIG. 4 is a side view illustrating a structure of an image forming apparatus according to a first exemplary embodiment of the present invention.
Figure 5:
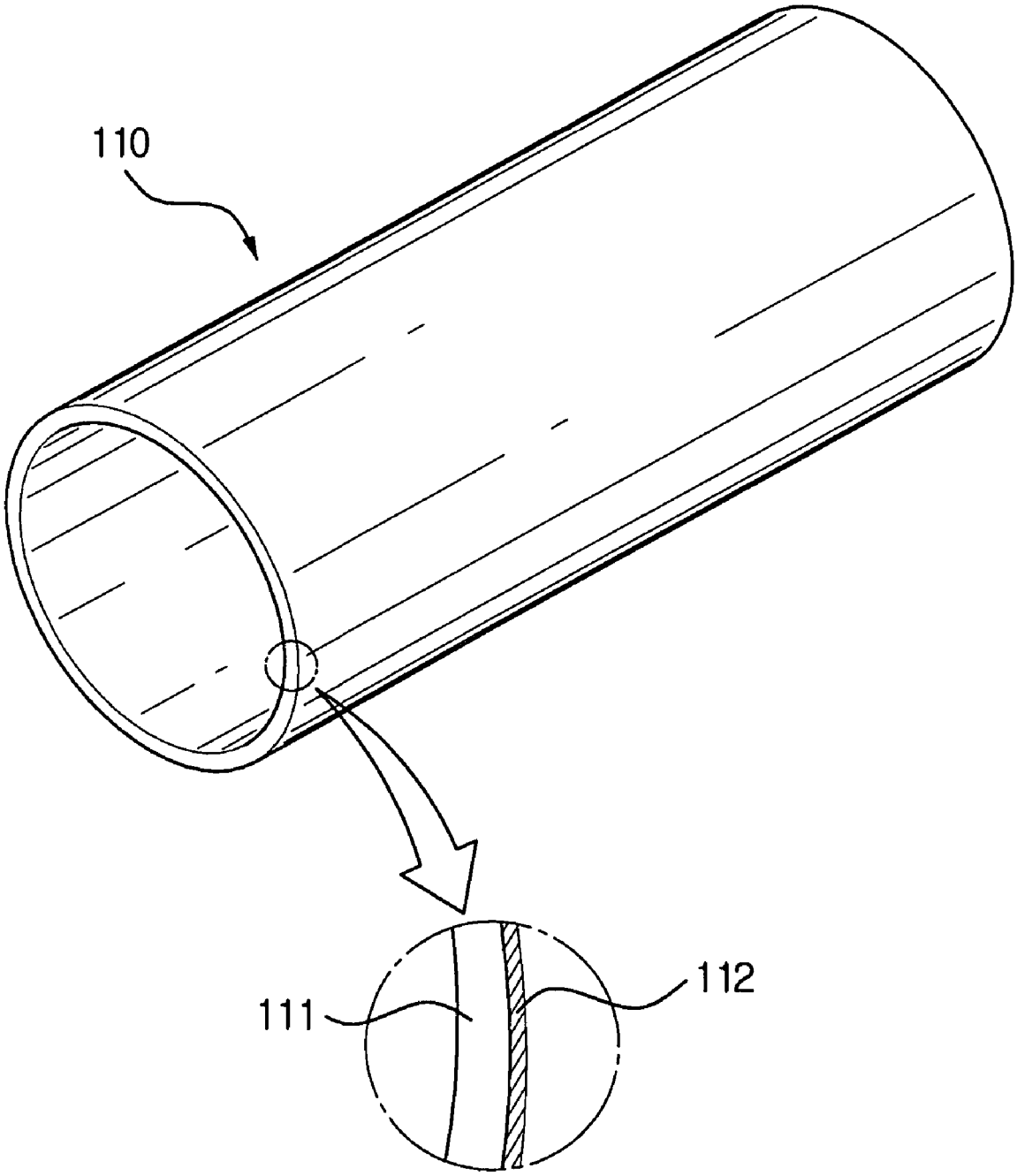
FIG. 5 is a perspective view illustrating a structure of an image forming element of the image forming apparatus according to the first exemplary embodiment.
Figure 6:
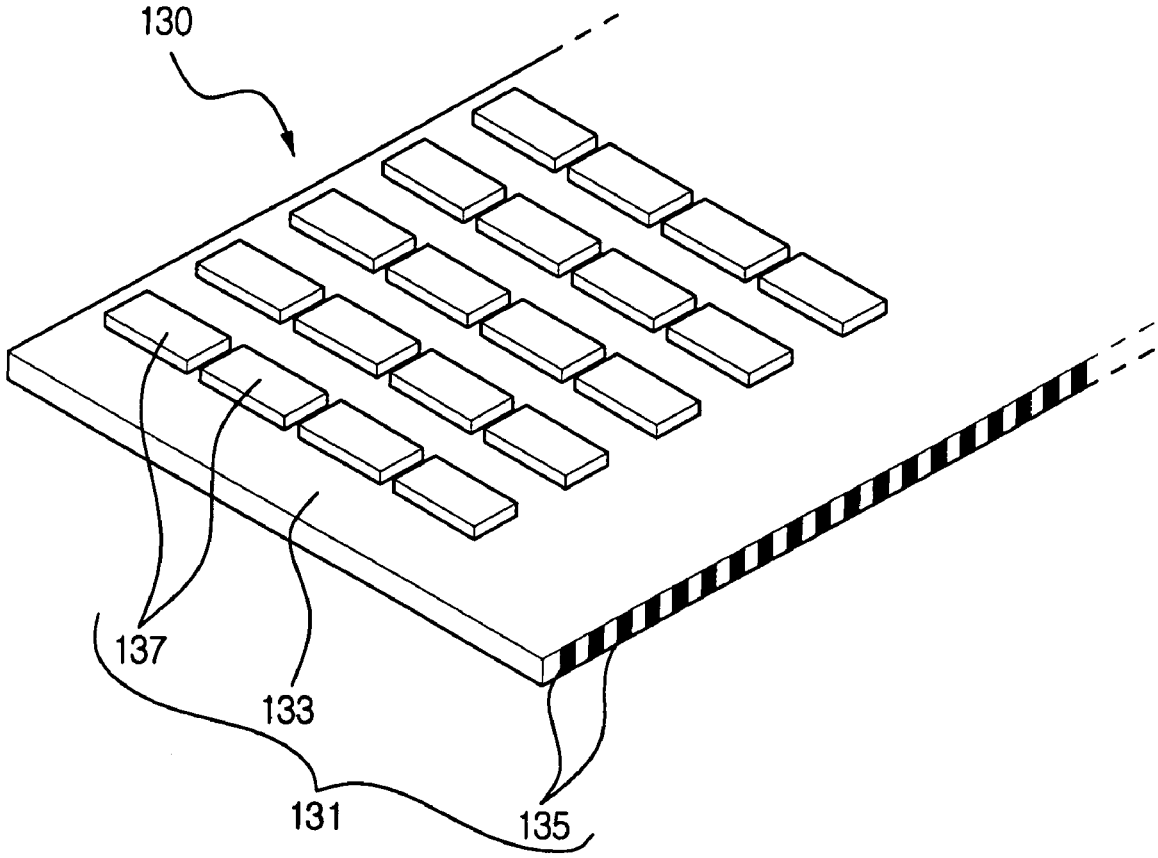
FIG. 6 is a perspective view illustrating a structure of an image developing unit of the image forming apparatus according to the first exemplary embodiment.
Figure 7:
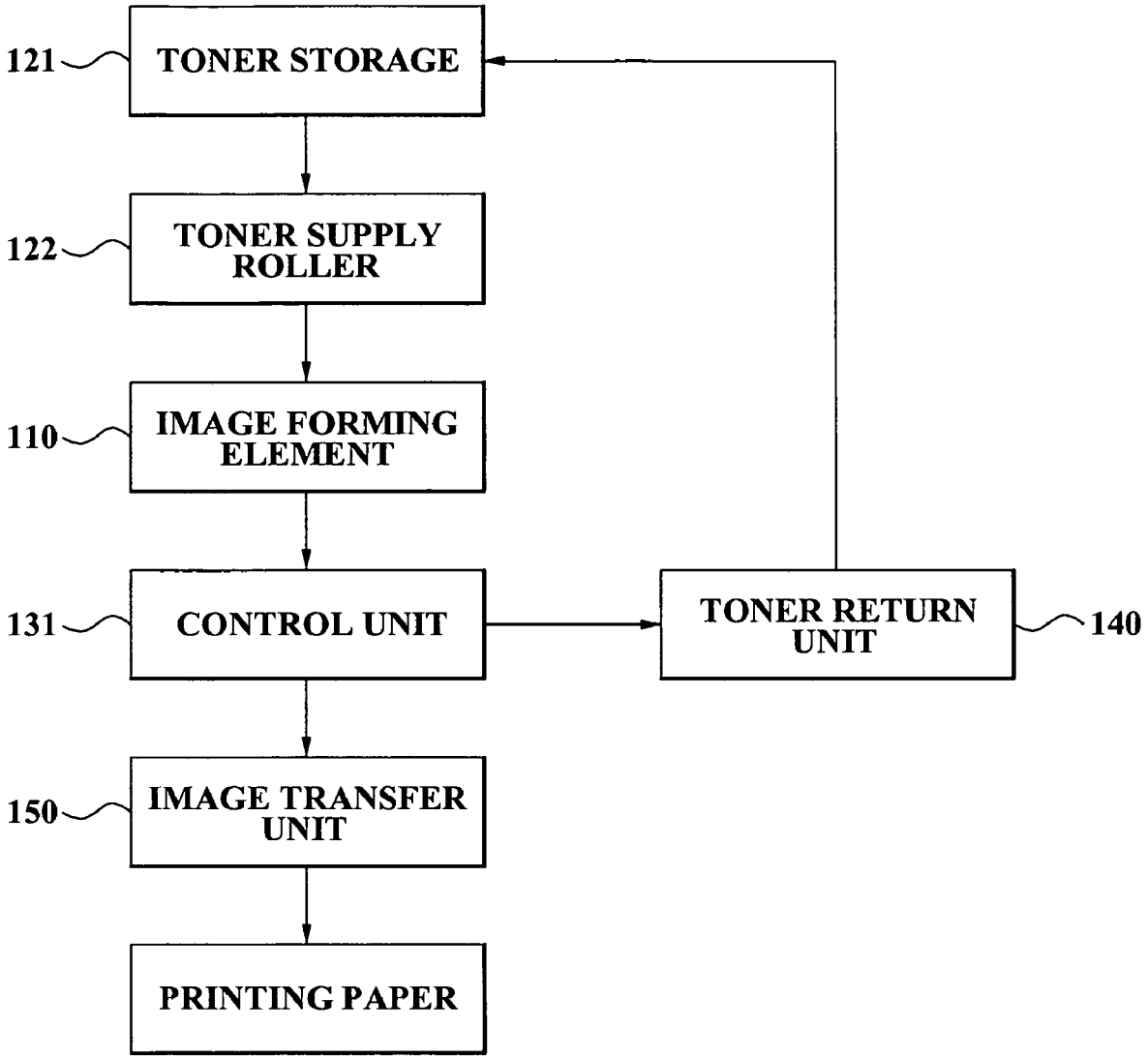
FIG. 7 is a block diagram schematically illustrating a transfer path of toner of the image forming apparatus according to the first exemplary embodiment.

FIG. 4 is a side view illustrating a structure of an image forming apparatus according to a first exemplary embodiment of the present invention, FIG. 5 is a perspective view illustrating a structure of an image forming element of the image forming apparatus according to the first exemplary embodiment, and FIG. 6 is a perspective view illustrating a structure of an image developing unit of the image forming apparatus according to the first exemplary embodiment. Also, FIG. 7 is a block diagram schematically illustrating a transfer path of toner of the image forming apparatus according to the first exemplary embodiment.

Referring to FIGS. 4 through 7, the image forming apparatus according to the first exemplary embodiment includes a toner supply unit 120, an image forming element 110 to which toner 10 is adsorbed from the toner supply unit 120 by an electrostatic force, an image developing unit 130 disposed externally from the image forming element 110, wherein said image developing unit 130 selectively separates from the image forming element 110 at least a portion of the toner 10 adsorbed to the image forming element 110 in order to develop an image on the image forming element 110, and a toner return unit 140 which returns the toner 10 separated from the image forming element 110 by the image developing unit 130 to the toner supply unit 120.

The toner supply unit 120 includes a toner storage 121 in which the toner 10 is stored and a toner supply roller 122 supplying the toner 10.

The image forming element 110 includes an image drum 111 formed in the shape of a cylinder formed of metal such as aluminum, which is disposed close to the toner supply roller 122 and rotates. An insulating layer 112 is disposed on an outer circumferential surface of the image drum 111. In the present exemplary embodiment, though a hollow cylinder type is used, a filled cylinder-shaped image forming element may be used according to the circumstances.

The image developing unit 130 includes a control unit 131 including a substrate 133 disposed outside of the image drum 111, a plurality of electrodes 135 disposed on an edge portion of the substrate 133 to be separated longitudinally in relation to the image drum 111 and disposed adjacent to an outer circumferential surface of the image drum 111, and a plurality of control chips 137, which may comprise application specific integrated circuits (ASICs), installed on the substrate 133 to individually apply a voltage to each electrode 135 in the plurality of electrodes 135.

In addition, though a case in which several tens of the electrodes 135 are disposed on one end portion of the substrate 133 is described for convenience of description in FIG. 6, the electrodes are substantially disposed over the entire edge of the substrate 133 with a pitch of approximately 40 μm in order to enable a resolution required for an image.

In this case, each of the electrodes 135 of the control unit 131 is formed to receive a voltage sufficient to separate the toner adsorbed to an outer circumferential surface area of the image drum 111, each of the electrodes 135 corresponding to the area.

The toner return unit 140 includes a rotary sleeve 141 disposed close to the outer circumferential surface of the image drum 111 and rotated. The toner 10 separated from the image drum 111 by each of the electrodes 135 of the control unit 131 may be returned to the toner supply unit 120 via the rotary sleeve 141.

A portion of the toner 10 adsorbed to the outer circumferential surface of the image drum 111 by the electrostatic force may be selectively separated from the image drum 111 by the control unit 131, thereby developing an image on the image drum 111.

Namely, when a voltage is applied to each of the electrodes 135, which is corresponding to control of each of the control chips 137 according to an image information signal, the relevant toner 10 adsorbed to the outer circumferential surface of the image drum 111 may be separated from the image drum 111 by the electrostatic force generated by each of the electrodes 135. The toner 10 separated from the image drum 111 may be returned to the toner supply unit 120 via the rotary sleeve 141.

On the other hand, the toner 10 that is not separated from the image drum 111 is transferred to a printing paper (not shown) via an image transfer unit 150 and may be fixed to the printing paper via a heating process.

As described above, in the present invention, the electrodes 135 which develop an image on the image drum 111 and the control unit 131 which controls a voltage applied to the electrodes 135 are installed outside of the image drum 111, thereby simplifying a process of manufacturing the image drum 111 and an entire manufacturing process to improve operation and productivity and largely reducing a manufacturing cost.

Figure 2:
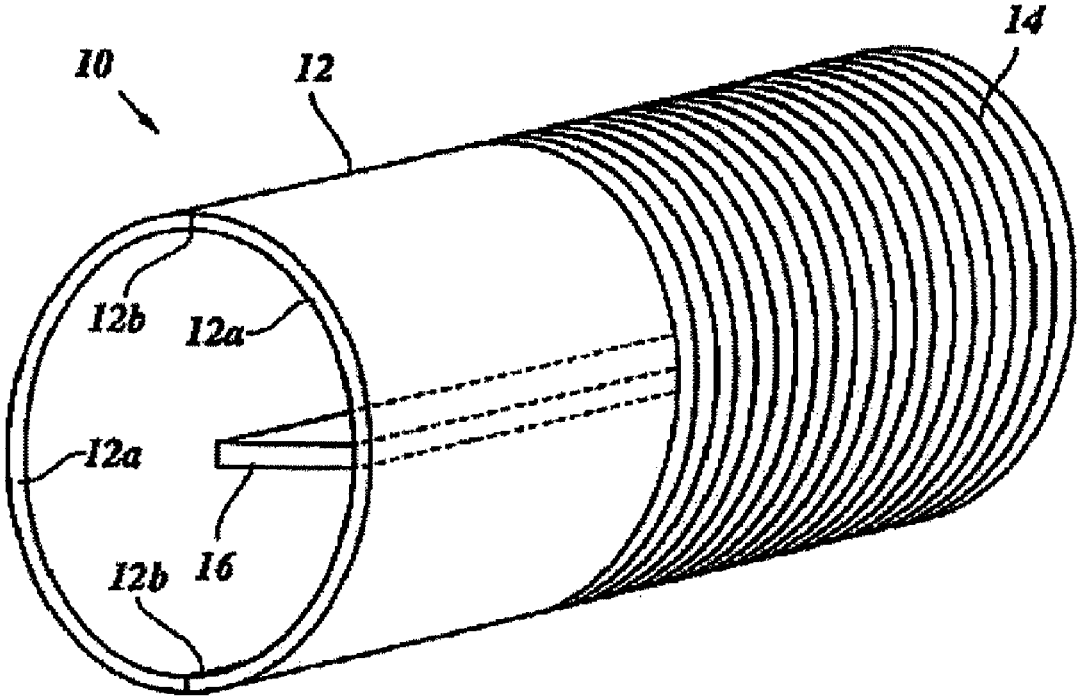
FIG.2 (RELATED ART)
FIG. 2 is a schematic perspective view illustrating a related image forming element according to a related art.
Figure 3:
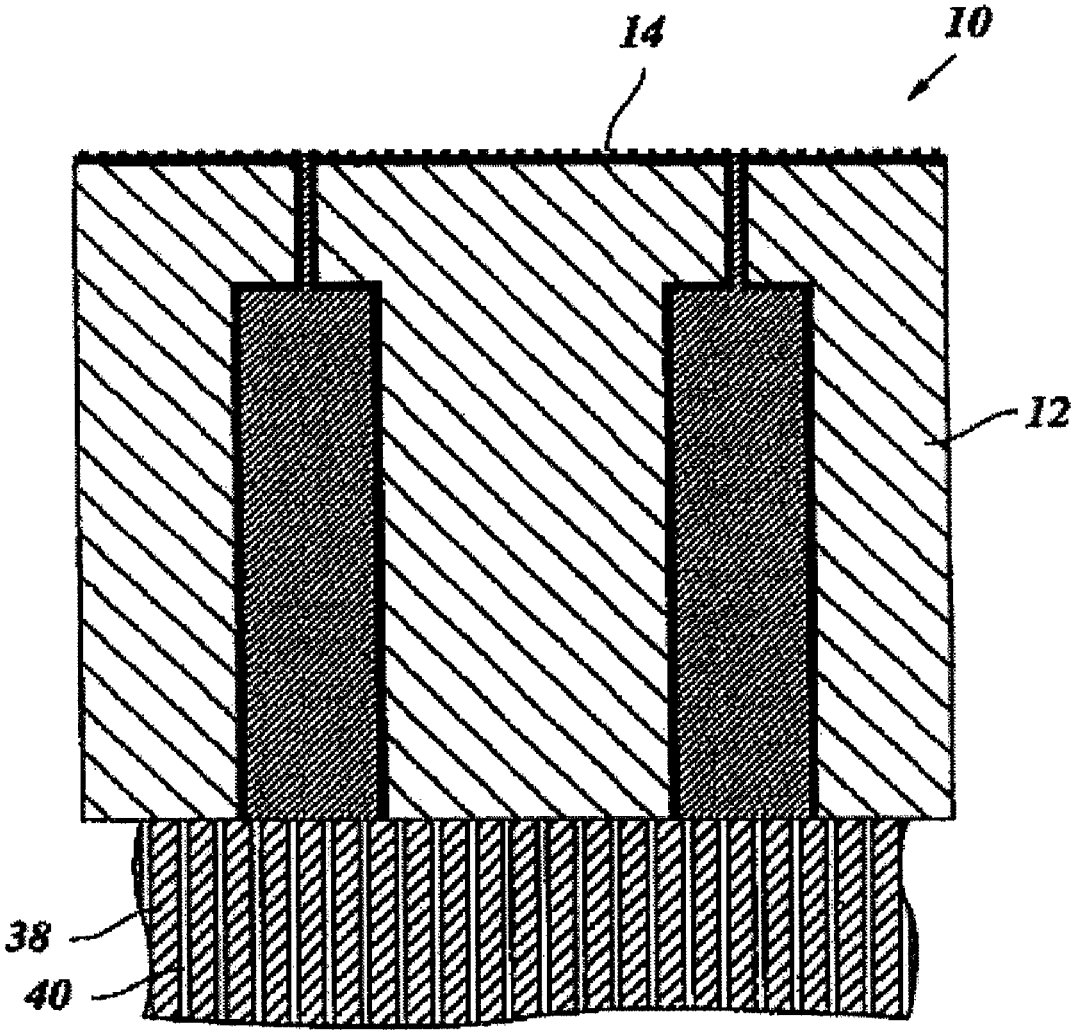
FIG.3 (RELATED ART)
FIG. 3 is an enlarged cross-sectional view illustrating a portion of the circumferential wall of the image forming element according to the related art.

In particular, a manufacturing process of ring electrodes (refer to 14 of FIGS. 2 and 3) that causes a problem in the related image forming apparatus and a electrical connection unit for electrically connecting the ring electrodes and the control unit (refer to 16 of FIG. 2), are eliminated and the electrodes 135 are formed by a micro pattern along a flat end portion of the substrate disposed outside of the image drum 111, the process of manufacturing the image drum 111 is thereby simplified significantly and manufacturing cost is reduced.

Figure 8:
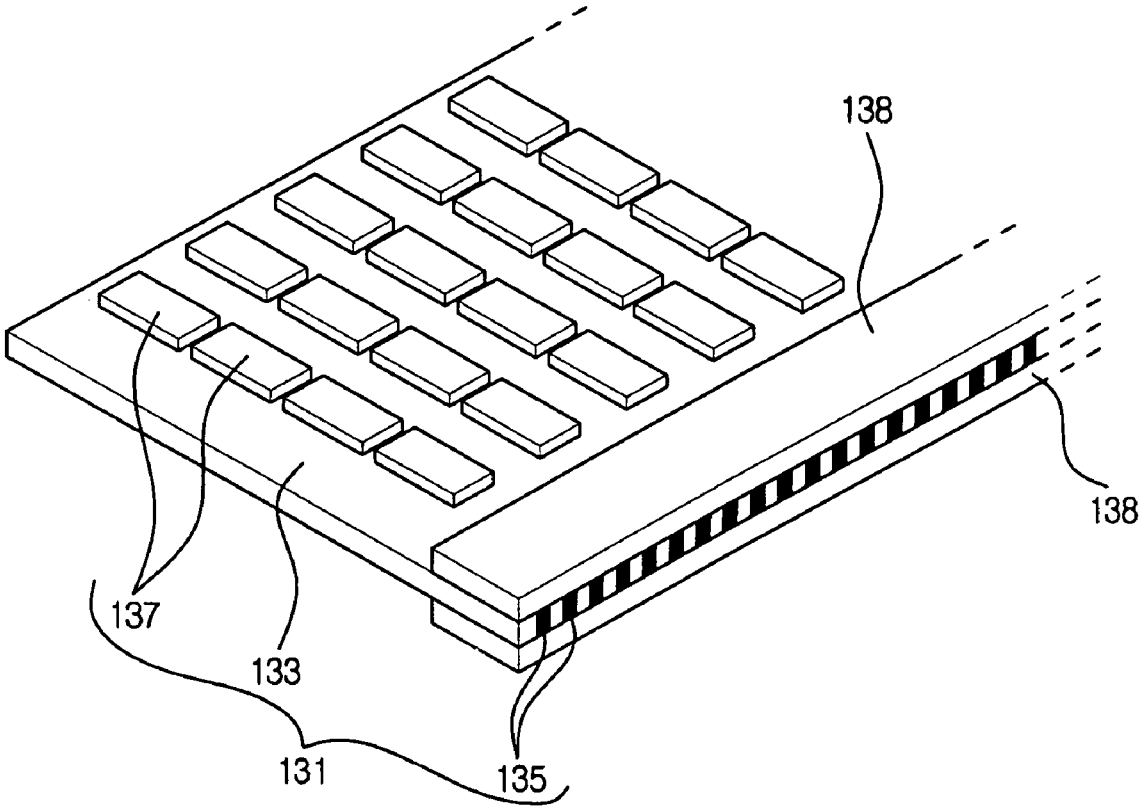
FIG. 8 is a perspective view illustrating a structure of an image developing unit according to a second exemplary embodiment of the present invention.

FIG. 8 is a perspective view illustrating a structure of an image developing unit according to a second exemplary embodiment of the present invention.

Referring to FIG. 8, the image forming apparatus according to the second exemplary embodiment is formed to generate a certain initiative attraction which separates the toner 10 adsorbed to the image drum 111 before a voltage is applied to each of the electrodes 135 of the control unit 131.

Namely, an auxiliary magnet 138 formed in the shape of a panel is disposed longitudinally on a top and a bottom of the substrate 133.

The auxiliary magnet 138 is formed to have a magnetic force smaller than a magnetic force that adsorbs the toner 10 to the image drum 111 and provides a certain initiative attraction which separates the toner 10 adsorbed to the image drum 111 from the image drum 111.

Namely, if a voltage required in separating the toner 10 adsorbed to the image drum 111 for each of the electrodes 135 is 10V, the auxiliary magnet 138 provides a magnetic force corresponding to an initiative attraction of 5V which separates the toner 10 adsorbed to the image drum, thereby substantially separating the toner 10 from the image drum by applying a voltage of more than 5V to the targeted one of the electrodes.

In addition, since other elements excluding the auxiliary magnet 138 are the same as the described element of the first exemplary embodiment, the same reference numeral is given to the same element and redundant detailed description thereof will be omitted.

Figure 9:
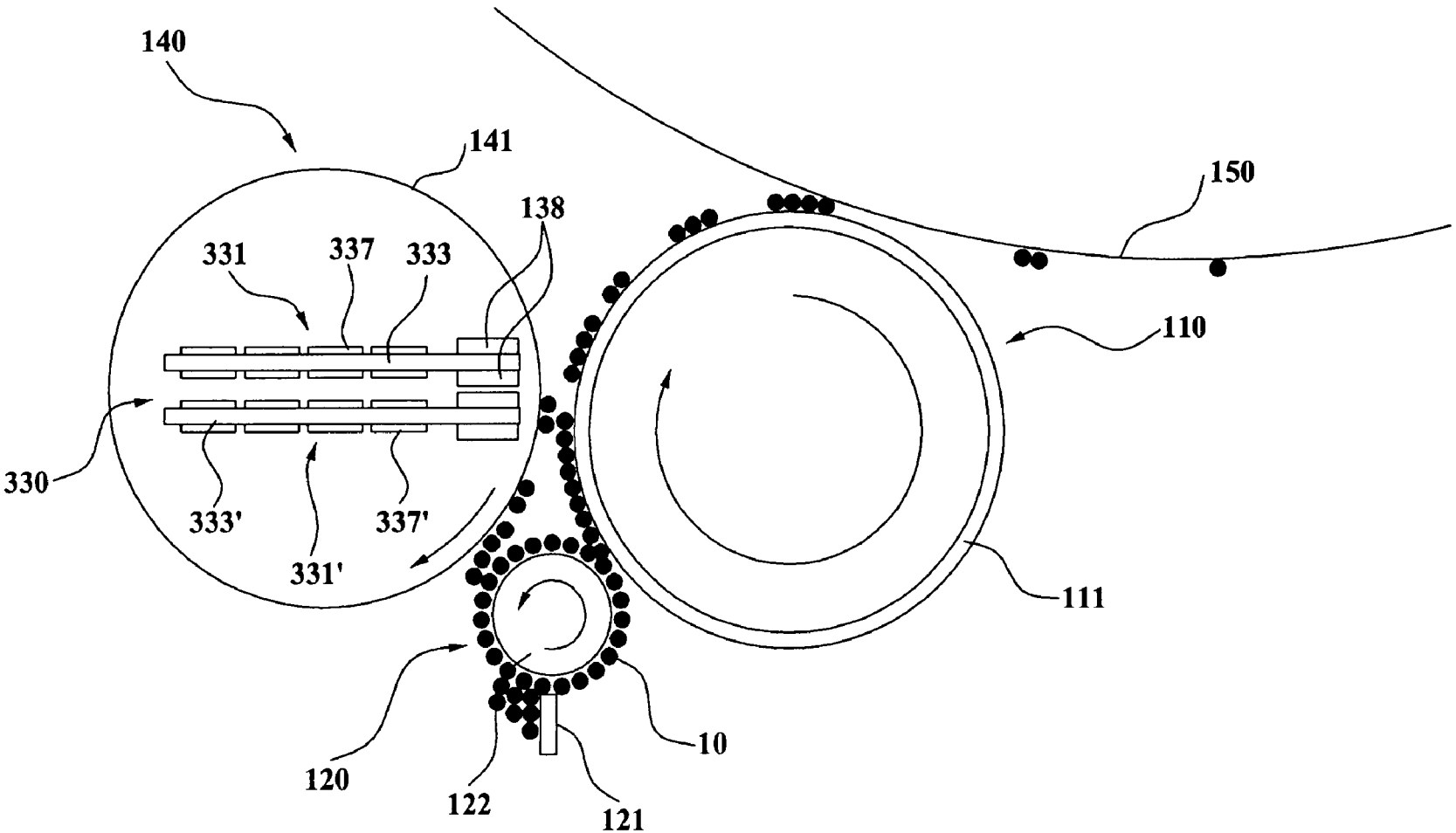
FIG. 9 is a side view illustrating a structure of an image forming apparatus according to a third exemplary embodiment of the present invention.
Figure 10:
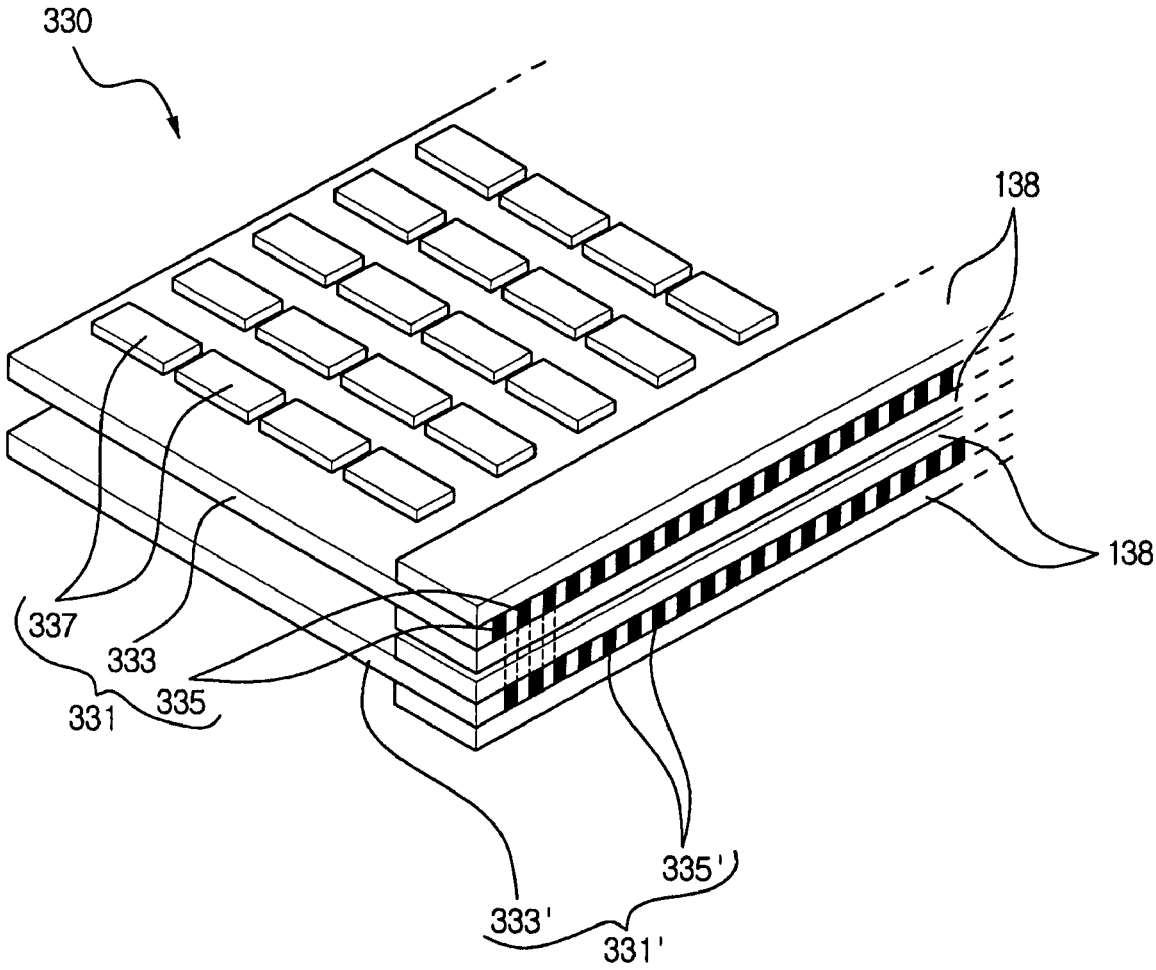
FIG. 10 is a perspective view illustrating a structure of an image developing unit of the image forming apparatus according to the third exemplary embodiment.

FIG. 9 is a side view illustrating a structure of an image forming apparatus according to a third exemplary embodiment of the present invention, and FIG. 10 is a perspective view illustrating a structure of an image developing unit of the image forming apparatus according to the third exemplary embodiment.

In addition, redundant detailed descriptions of elements will be omitted.

Referring to FIGS. 9 and 10, the image forming apparatus according to the third exemplary embodiment includes the toner supply unit 120, the image forming element 110 to which the toner 10 is adsorbed from the toner supply unit 120 by an electrostatic force, an image developing unit 330 disposed on an outer side of the image forming element 110, wherein said image developing unit selectively separates from the image forming element 110 at least a portion of the toner 10 adsorbed to the image forming element 110 in order to develop an image on the image forming element 110, and the toner return unit 140 which returns the toner 10 separated from the image forming element 110 by the image developing unit 330 to the toner supply unit 120. The image developing unit 330 includes a plurality of control units 331 and 331' respectively vertically deposited and including a plurality of electrodes 335 and 335' capable of individually applying a voltage to develop a high-resolution image.

Hereinafter, a case in which the image developing unit 330 includes a first control unit 331 and a second control unit 331' disposed below the first control unit 331 and the electrodes 335 and 335' of respective control units 331 and 331' are longitudinally disposed to alternate with each other.

The first control unit 331 includes a first substrate 333 disposed outside of the image drum 111, a plurality of first electrodes 335 disposed on an edge portion of the first substrate 333 and longitudinally disposed at a certain interval to be separated from the image drum 111, to be electrically insulated and adjacent to an outer circumferential surface of the image drum 111, and a plurality of first control chips 337 installed on a flat surface of the first substrate 333 to individually apply voltage to each of the first electrodes 335.

The second control unit 331' includes a second substrate 333' vertically deposited below the first substrate, a plurality of second electrodes 335' disposed on an edge portion of the second substrate 333' to be longitudinally disposed at a certain interval to alternate with each of the plurality of the first electrodes 335 and adjacent to the outer circumferential surface of the image drum 111, and a plurality of second control chips 337' installed on a flat surface of the second substrate 333' to individually apply voltage to each of the second electrodes 335'.

The first control unit 331 and the second control unit 331' may include auxiliary magnets formed to have a magnetic force smaller than a magnetic force that adsorbs the toner 10 to the image drum 111 in order to provide an initiative attraction which separates the toner 10 adsorbed to the image drum 111 from the image drum 111, respectively.

According to the construction, a portion of the toner 10 adsorbed to the outer circumferential surface of the image drum 111 is selectively separated from the image drum 111 by the first control unit 331 and the second control unit 331', thereby developing a high-resolution image on the image drum 111.

Figure 11A:
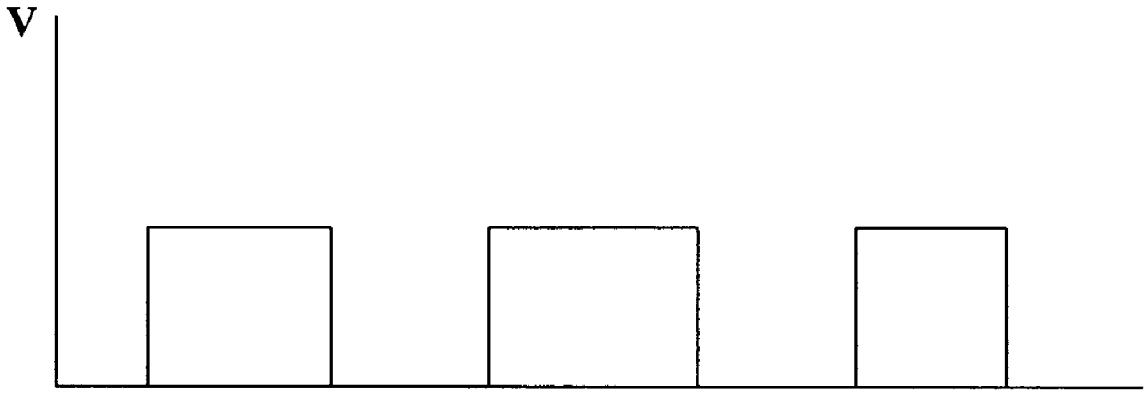
FIGS. 11 through 14 are graphs and a side view illustrating a state of applying a voltage of each of control units and a state of adsorbing toner by each of the plurality of the control units in an image forming apparatus according to a third exemplary embodiment of the present invention.
Figure 11B:
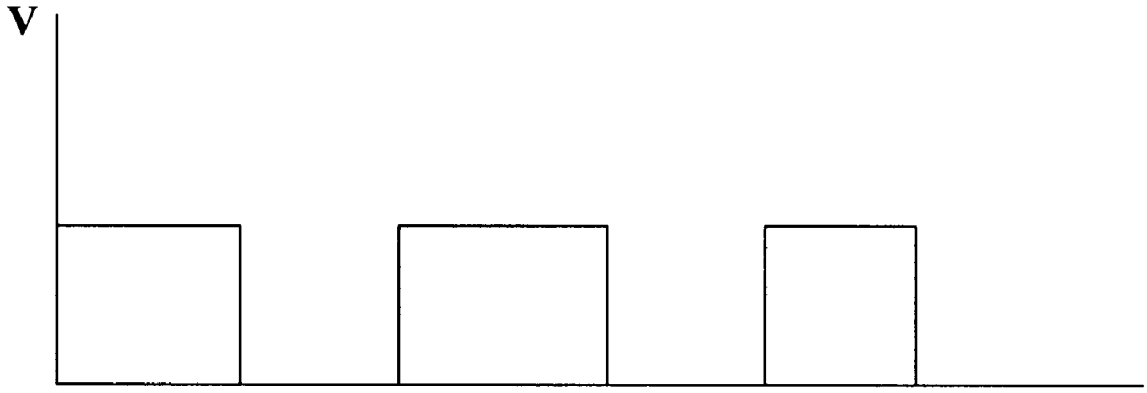
Figure 12:
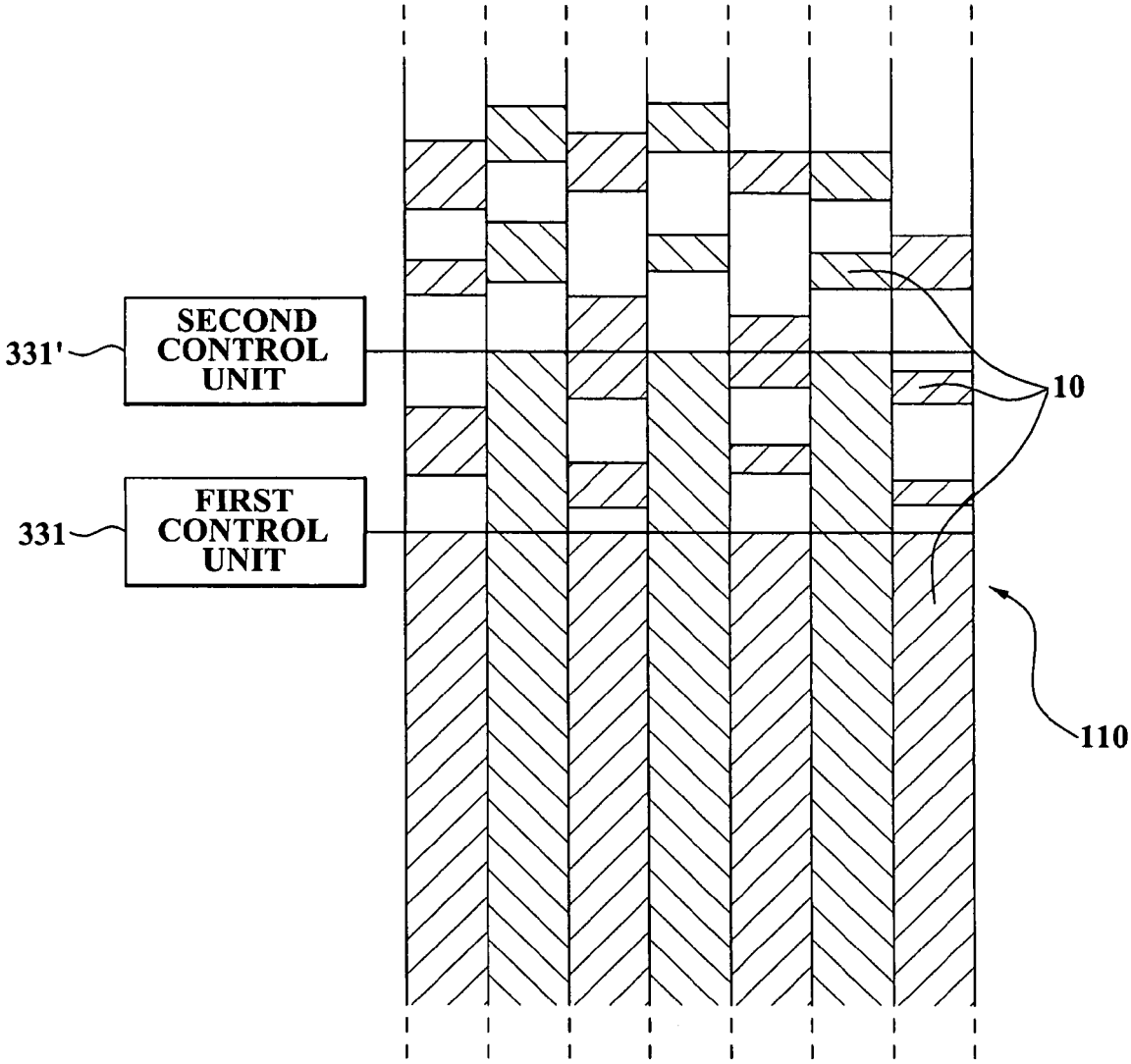

Namely, as shown in FIGS. 11 and 12, when a voltage is individually applied to each of the electrodes 335 and 335' in response to control of a first control chip 337 and a second control chip 337' according to an image information signal, the toner 10 adsorbed to a relevant area of the outer circumferential surface of the image drum 111 may be separated from the image drum 111 by an electrostatic force generated from each of the electrodes 335 and 335'. The toner 10 separated from the image drum 111 may be returned to the toner supply unit 120 via the rotary sleeve 141.

In this case, FIG. 11A illustrates a state of a voltage applied to the first electrodes 335 of the first control unit 331, and FIG. 11B illustrates a state of a voltage applied to the second electrodes 335' of the second control unit 331'.

On the other hand, the toner 10 that is not separated from the image drum 111 is transferred to a printing paper via the image transfer unit 150 and may be fixed to the printing paper via a heating process.

In addition, in the described exemplary embodiment, the image developing unit 330 includes the plurality of the electrodes 335 and 335' individually applying a voltage and respectively including the plurality of the control units 331 and 331' vertically deposited. However, one of the control units 331 and 331' may apply a same voltage at the same time, and the other of the control units 331 and 331' may individually apply a voltage.

In addition, hereinafter, the same reference numerals are given to elements to be described later.

The first control unit 331 includes a first substrate 333 disposed outside of the image drum 111, a plurality of first electrodes 335 disposed on an edge portion of the first substrate 333 to be longitudinally disposed at a certain interval to be separated from the image drum 111, to be electrically insulated and adjacent to an outer circumferential surface of the image drum 111, and a plurality of first control chips 337 installed on a flat surface of the first substrate 333 to individually apply voltage to each of the first electrodes 335.

The second control unit 331' includes a second substrate 333' vertically deposited below the first substrate, a plurality of second electrodes 335' disposed on an edge portion of the second substrate 333' to be longitudinally disposed at a certain interval to alternate with each of the plurality of the first electrodes 335 and adjacent to the outer circumferential surface of the image drum 111, and a plurality of second control chips 337' installed on a flat surface of the second substrate 333' to individually apply voltage to each of the second electrodes 335'.

Figure 13A:
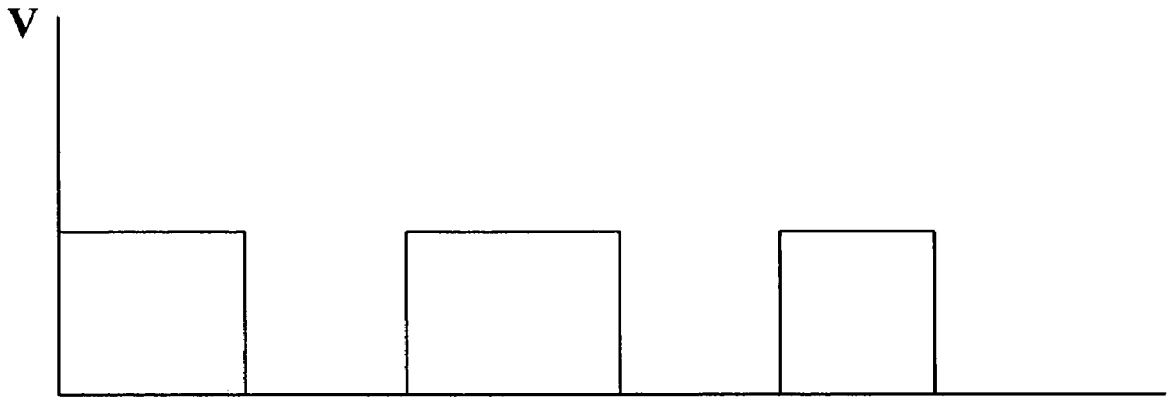
Figure 13B:
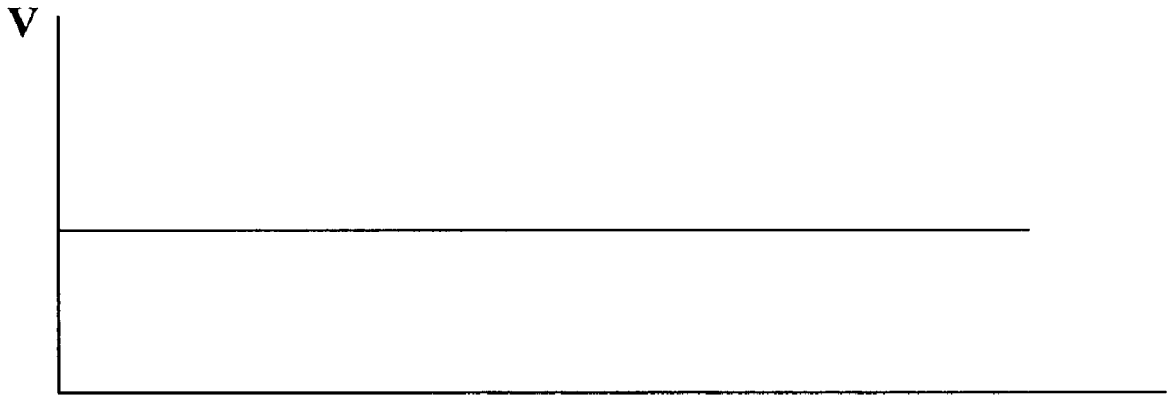
Figure 14:
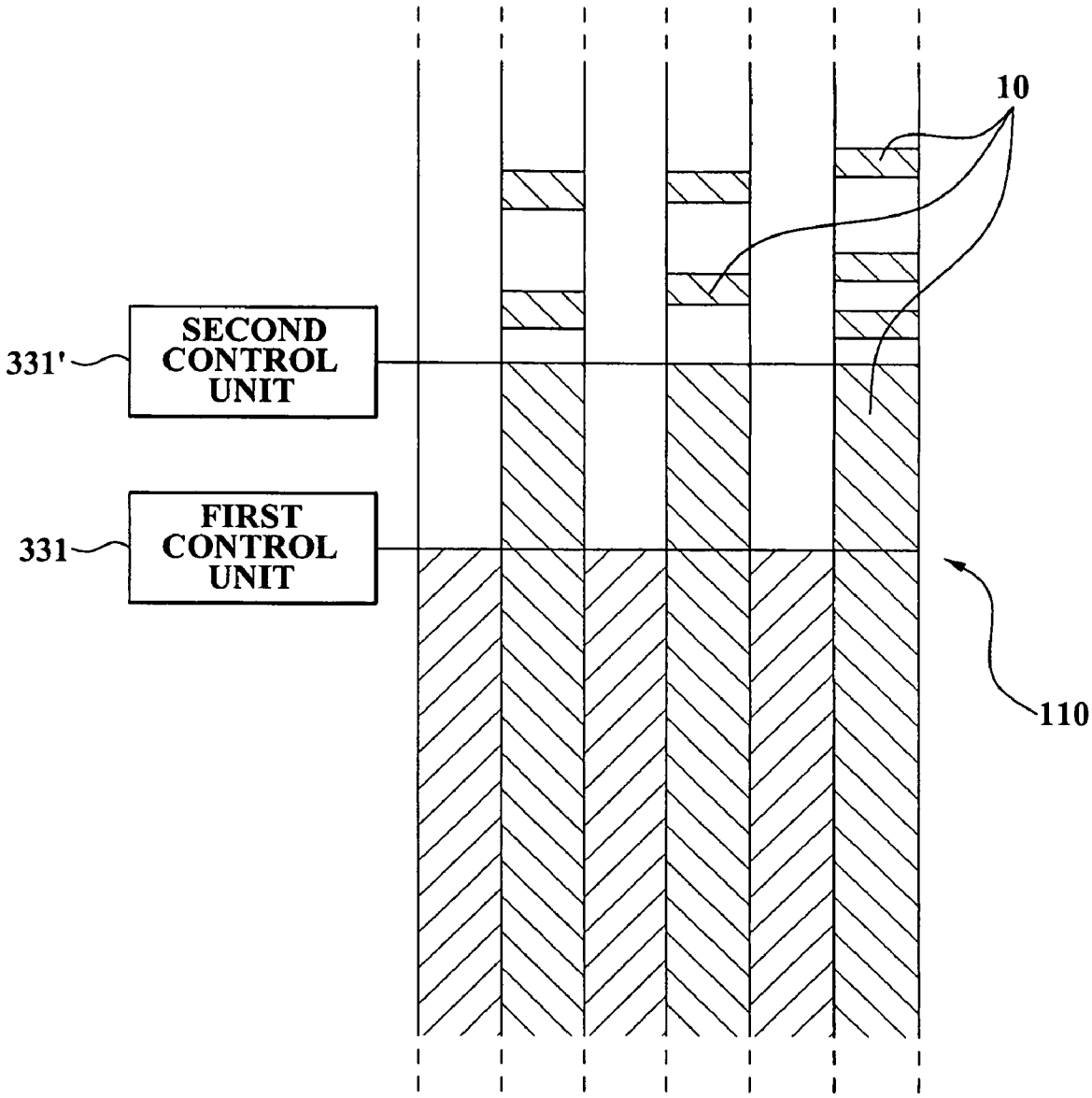

According to the described construction, as shown in FIGS. 13 and 14, when the same voltage is applied to relevant electrodes of the plurality of the first electrodes 335 at the same time in response to control of the first control chip 337 and a voltage is individually applied to the second electrodes 335' in response to control of the second control chip 337' according to an image information signal, the toner 10 adsorbed to a relevant area of the outer circumferential surface of the image drum 111 may be separated from the image drum 111 by an electrostatic force generated from each of the electrodes 335 and 335'.

Namely, in all of the toner 10 adsorbed to an area of the outer circumferential, some toner corresponding to each of the first electrodes 335 of the first control unit 331 may be separated from the image drum 111 throughout, by applying the same voltage to the first electrodes 335. However, the other toner corresponding to each of the second electrodes 335' of the second control unit 331' may be selectively separated from the image drum 111 by individually applying a voltage to each of the second electrodes 335'.

In this case, FIG. 13A illustrates a state of a voltage applied to the first electrodes 335 of the first control unit 331, and FIG. 13B illustrates a state of a voltage applied to the second electrodes 335' of the second control unit 331'.

Figure 15:
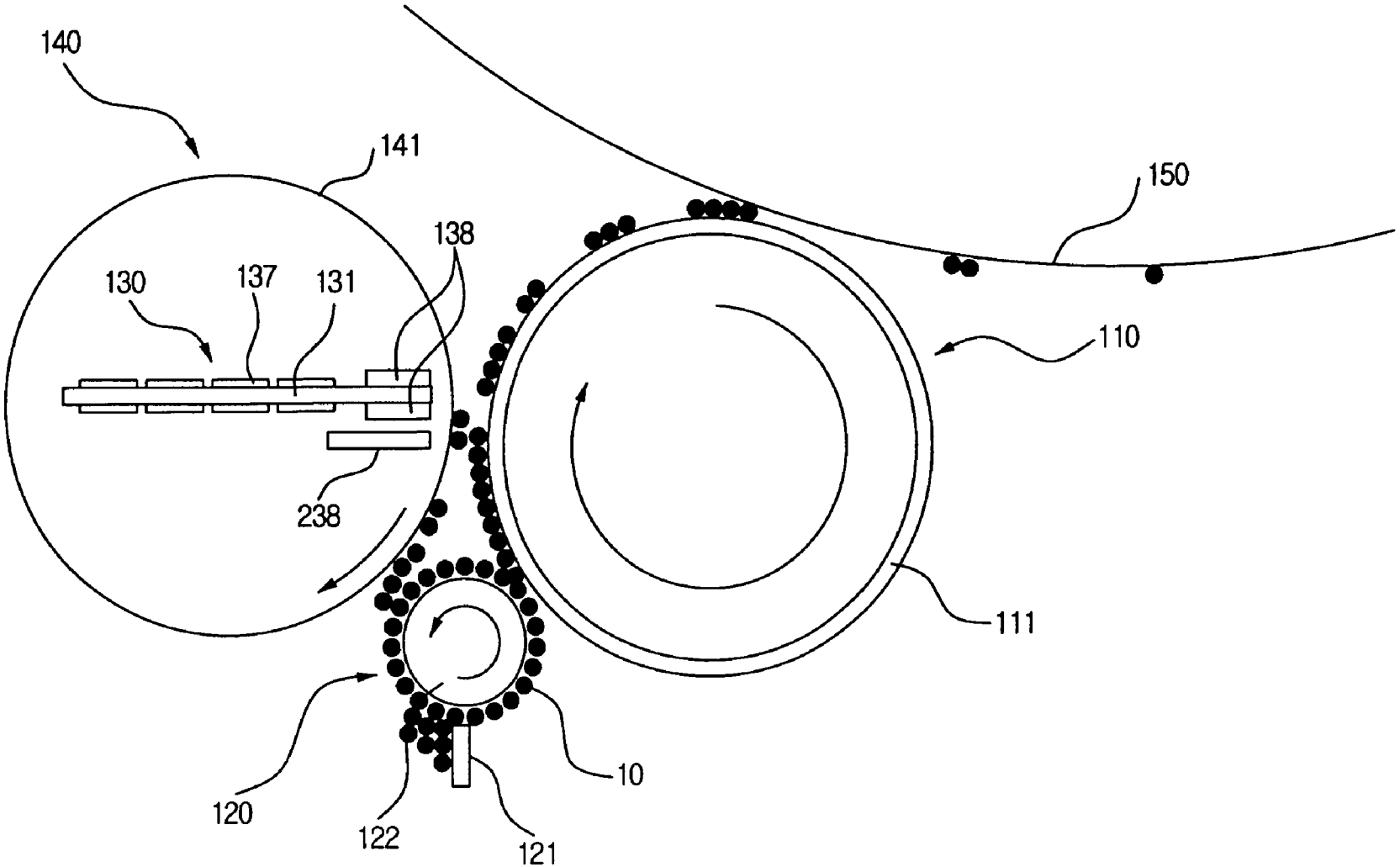
FIG. 15 is a side view illustrating a structure of an image forming apparatus according to a fourth exemplary embodiment of the present invention.
Figure 16:
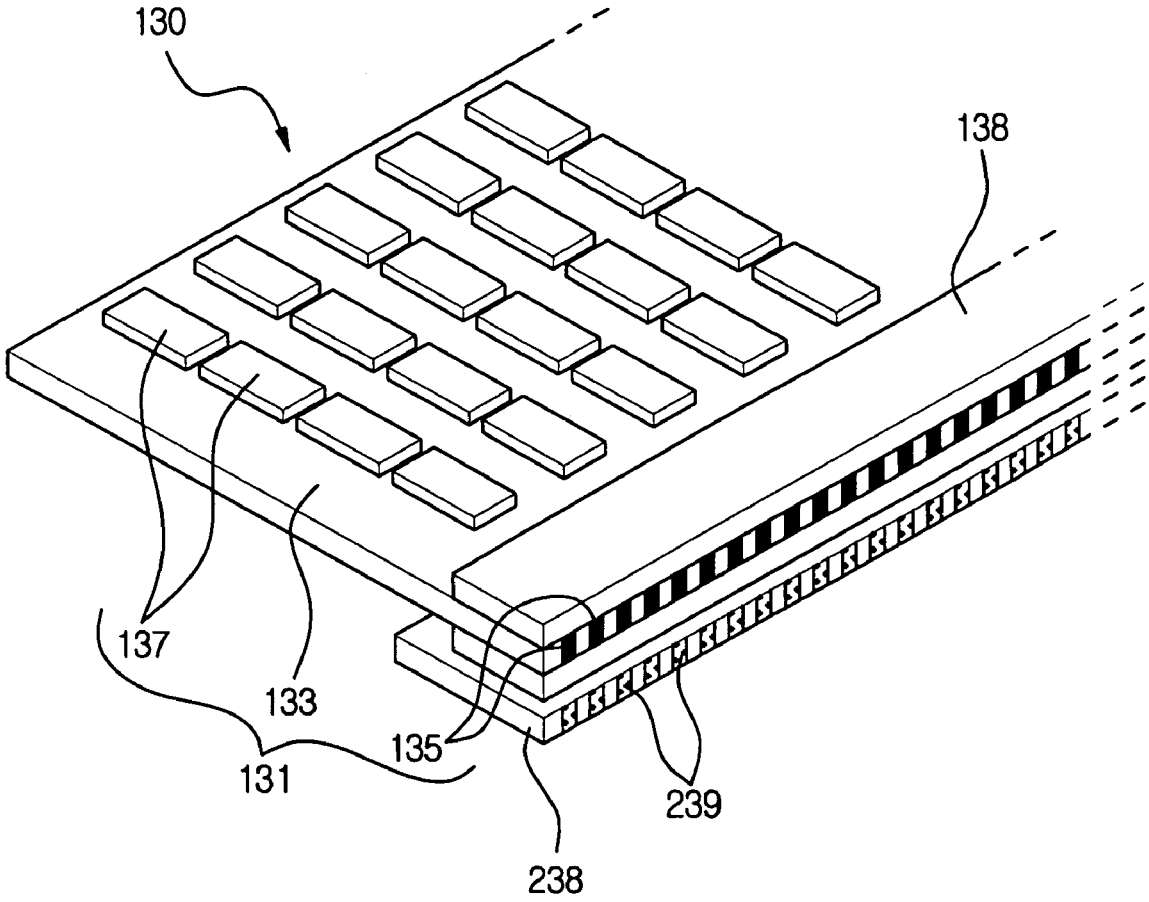
FIG. 16 is a perspective view illustrating structures of an image developing unit and magnet of the image forming apparatus according to the fourth exemplary embodiment.
Figure 17:
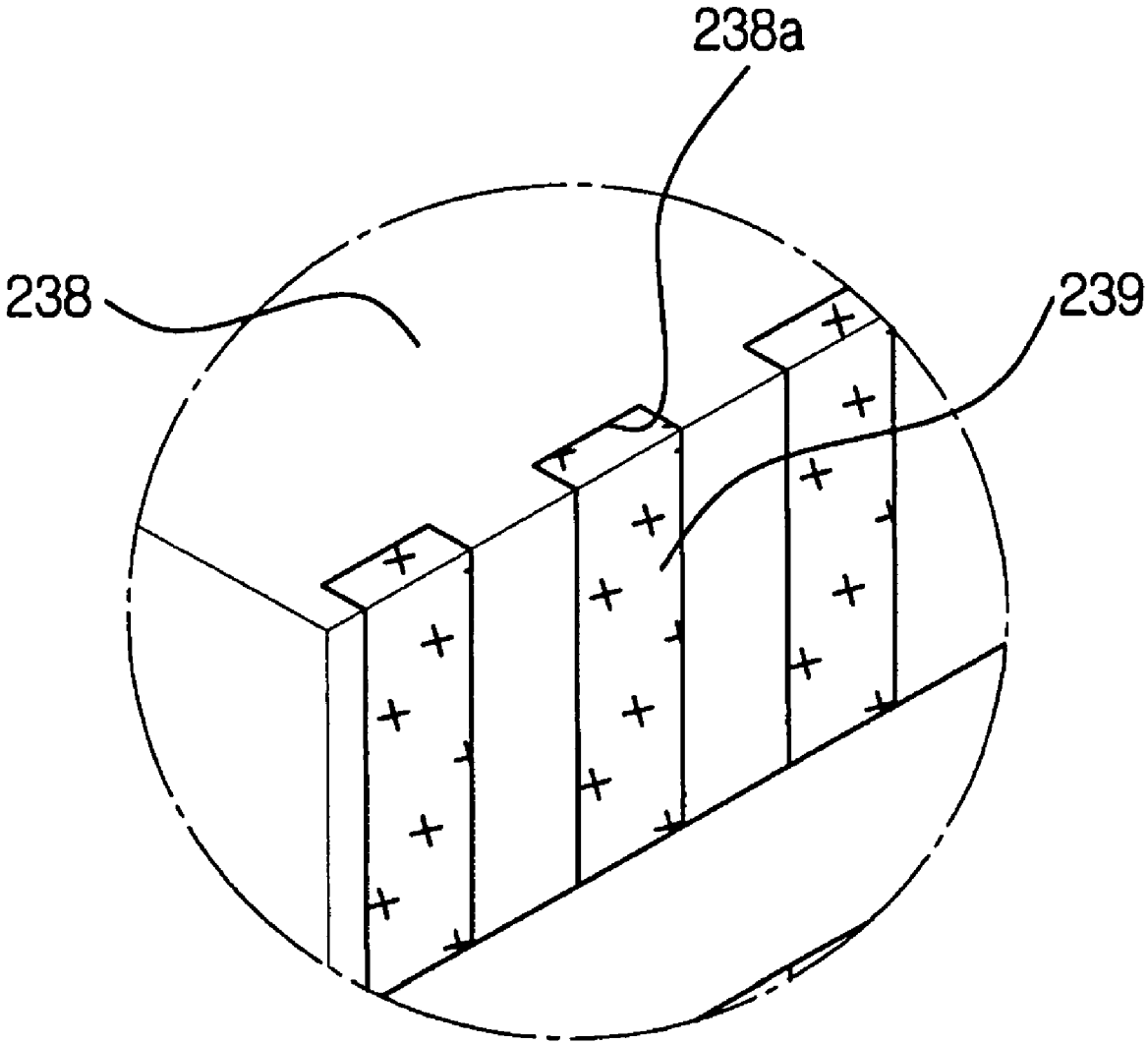
FIG. 17 is a perspective view illustrating a modified example of a magnetic insulating unit of the image forming apparatus according to the fourth exemplary embodiment.

FIG. 15 is a side view illustrating a structure of an image forming apparatus according to a fourth exemplary embodiment of the present invention, FIG. 16 is a perspective view illustrating structures of an image developing unit and magnet of the image forming apparatus according to the fourth exemplary embodiment, and FIG. 17 is a perspective view illustrating a modified example of a magnetic insulating unit of the image forming apparatus according to the fourth exemplary embodiment.

In addition, redundant detailed descriptions of elements will be omitted.

Referring to FIGS. 15 and 16, the image forming apparatus according to the fourth exemplary embodiment includes a toner supply unit 120, an image forming element 110 to which toner 10 is adsorbed by an electrostatic force from the toner supply unit 120, an image developing unit 130 including a substrate 133 and a control unit 131 including electrodes 135 and control chips 137 which selectively separates at least a portion of the toner 10 adsorbed to the image forming element 110, a magnet 238 having a magnetic force at least greater than a magnetic force that adsorbs the toner to the image forming element 110, longitudinally disposed in relation to the image forming element 110, and disposed to be vertical to the substrate 133, a magnetic insulating unit 239 disposed longitudinally in relation to the image forming element 110 and on the vertical line of each electrode, vertical to a magnetic force generation surface of the magnet 238 with respect to the image forming element 110, and a toner return unit 140 which returns the toner 10 separated from the image forming element 110 by the image developing unit 130.

The control unit 131 includes a substrate 133 formed in the shape of a panel disposed outside of the image drum 111 to be parallel to a rotation axis of the image drum 111, a plurality of the electrodes 135 disposed on an edge portion of the substrate 133 to be longitudinal and separated in relation to the image drum 111 and close to an outer circumferential surface of the image drum 111, and a plurality of the control chips 137 installed on a flat surface of the substrate 133 to individually apply a voltage to each of the electrodes 135.

The magnet 238 formed in the shape of a panel longitudinal in relation to the image drum 111 is disposed below the control unit 131. In this case, the magnet 238 has a magnetic force sufficient to separate the toner 10 adsorbed to an area of the outer circumferential surface of the image drum 111 from the image drum 111.

The magnetic insulating unit 239 is formed of a magnetic insulating material and disposed on the same line with each of the electrodes 135 to be vertical to the magnet 238 and separated at a certain interval such that the magnetic force of the magnet 238 may function only in the area of the circumferential surface of the image drum 111, corresponding to a gap between each of the electrodes 135 of the control unit 131.

Also, the control unit 131 may further include the auxiliary magnet 138 having a magnetic force smaller than the force of adsorbing the toner 10 to the image drum 111 and providing a certain initiative attraction which separates the toner 10 adsorbed to the image drum 111 from the image drum 111.

According to the described construction, a portion of the toner 10 adsorbed to the outer circumferential surface of the image drum by an electrostatic force from the toner supply unit 120 may be selectively separated from the image drum 111 and another portion of the toner 10 may be separated from the image drum 111 by the magnet 238.

Namely, the toner 10 adsorbed to the area of the outer circumferential surface of the image drum 111, corresponding to each of the electrodes 135 may be selectively separated from the image drum 111 as a voltage is individually applied to each of the electrodes 135, or the toner 10 adsorbed to the area of the outer circumferential surface of the image drum 111, corresponding to the gap between each of the electrodes of the control unit 131, may be separated from the image drum 111 by the magnetic force of the magnet 238.

On the other hand, the described magnetic insulating unit 239 may be formed on a surface of the magnet 238 as shown in FIG. 16 and may be formed within a containing groove 238*a* on the surface of the magnet 238 at a predetermined depth as shown in FIG. 17.

As described above, according to the image forming apparatus according to an aspect of the present invention, electrodes for developing an image on an image drum and a control unit for controlling a voltage applied to the electrodes are installed outside of the image drum, thereby simplifying a process of manufacturing the image drum and the entire manufacturing process to improve operations and productivity and reduce a manufacturing cost.

Particularly, mass production is made easier by simplifying the process of manufacturing the image drum, and the cost of a product may be lowered by reducing the manufacturing cost.

Also, a high-resolution image may be realized via a plurality of control units epitaxially deposited, and unnecessary voltage consumption may be prevented by using a magnet.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An image forming apparatus comprising:

a toner supply unit;

an image forming element to which toner is adsorbed from the toner supply unit;

an image developing unit disposed on an outer side of the image forming element which selectively separates from the image forming element at least a part of the toner adsorbed to the image forming element in order to develop an image on the image forming element; and a toner return unit including a rotary sleeve passing between the image forming element and the image developing unit, wherein the rotary sleeve returns the toner separated from the image forming element by the image developing unit to the toner supply unit.

2. The apparatus of claim 1, wherein the image developing unit comprises a control unit including a plurality of electrodes, each of the electrodes disposed to be separated in a lengthwise direction of the image forming element.

3. The apparatus of claim 2, wherein a plurality of the control units are epitaxially overlapped in a direction of a thickness of the control unit.

4. The apparatus of claim 3, wherein the electrodes of each of the plurality of the control units are disposed to alternate with each other, in the lengthwise direction of the image forming element.

5. The apparatus of claim 1, further comprising an auxiliary magnet formed to have a magnetic force smaller than a magnetic force that adsorbs the toner to the image forming element and disposed in the lengthwise direction of the image forming element to be disposed in a direction of a thickness of the image developing unit.

6. An image forming apparatus comprising:

a toner supply unit;

an image forming element formed in the shape of a cylinder to which toner is adsorbed from the toner supply unit;

an image developing unit comprising a control unit including a substrate disposed outside of the image forming element, a plurality of electrodes disposed on an edge portion of the substrate to be separated in the direction of length of the image forming element and disposed adjacent to an outer circumferential surface of the image forming element, and a plurality of control chips installed on the substrate to individually apply a voltage to each of the electrodes and, wherein said control unit selectively separates from the image forming element at least a part of the toner adsorbed to the image forming element; and a toner return unit including a rotary sleeve passing between the image forming element and the image developing unit, wherein the rotary sleeve returns the toner separated from the image forming element by the image developing unit, to the toner supply unit.

7. The apparatus of claim 6, further comprising an auxiliary magnet formed to have a magnetic force smaller than a magnetic force that adsorbs the toner to the image forming element and disposed in the lengthwise direction of the image forming element to be disposed in a direction of a thickness of the control unit.

8. An image forming apparatus comprising:

a toner supply unit;

an image forming element formed in the shape of a cylinder to which toner is adsorbed from the toner supply unit;

an image developing unit which selectively separates from the image forming element at least a part of the toner adsorbed to the image forming element, said image developing unit comprising:

a first control unit including a first substrate disposed on an outer side of the image forming element, a plurality of first electrodes disposed on an edge portion of the first substrate to be disposed adjacent to an outer circumferential surface of the image forming element, and a plurality of first control chips installed on the first substrate to individually apply a voltage to each of the plurality of the first electrodes; and a second control unit including a second substrate epitaxially deposited in a direction of a thickness of the first substrate, a plurality of second electrodes disposed on an edge portion of the second substrate to be separated to alternate with each of the plurality of the first electrodes in a lengthwise direction of the image forming element and to be disposed adjacent to the outer circumferential surface of the image forming element, and a plurality of second control chips installed on the second substrate to individually apply a voltage to each of the plurality of the second electrodes; and a toner return unit including a rotary sleeve passing between the image forming element and the image developing unit, wherein the rotary sleeve returns the toner separated from the image forming element by the image developing unit, to the toner supply unit.

9. The apparatus of claim 8, further comprising a plurality of auxiliary magnets formed to have a magnetic force smaller than a magnetic force that adsorbs the toner to the image forming element and disposed in the lengthwise direction of the image forming element to be disposed in a direction of a thickness of each of the control units, respectively.

10. An image forming apparatus comprising:

a toner supply unit;

an image forming element formed in the shape of a cylinder to which toner is adsorbed from the toner supply unit;

an image developing unit which selectively separates from the image forming element at least a part of the toner adsorbed to the image forming element, said image developing unit comprising:

a first control unit including a first substrate disposed on an outer side of the image forming element, a plurality of first electrodes disposed on an edge portion of the first substrate to be disposed adjacent to an outer circumferential surface of the image forming element, and a plurality of first control chips installed on the first substrate to apply an equal voltage to the plurality of the first electrodes; and a second control unit including a second substrate epitaxially deposited in a direction of a thickness of the first substrate, a plurality of second electrodes disposed on an edge portion of the second substrate to be separated to alternate with each of the plurality of the first electrodes in a lengthwise direction of the image forming element and to be disposed adjacent to the outer circumferential surface of the image forming element, and a plurality of second control chips installed on the second substrate to individually apply a voltage to each of the plurality of the second electrodes; and a toner return unit including a rotary sleeve passing between the image forming element and the image developing unit, wherein the rotary sleeve returns the toner separated from the image forming element by the image developing unit, to the toner supply unit.

11. The apparatus of claim 10, further comprising a plurality of auxiliary magnets formed to have a magnetic force smaller than a magnetic force that adsorbs the toner to the image forming element and disposed in the lengthwise direction of the image forming element to be disposed in a direction of a thickness of each of the plurality of the control units, respectively.

12. An image forming apparatus comprising:

a toner supply unit;

an image forming element formed in the shape of a cylinder to which toner is adsorbed from the toner supply unit;

an image developing unit comprising a control unit including a substrate disposed on an outer side of the image forming element, a plurality of electrodes disposed on an edge portion of the substrate to be separated in the lengthwise direction of the image forming element and disposed adjacent to an outer circumferential surface of the image forming element, and a plurality of control chips installed on the substrate to individually apply voltage to each of the electrodes, wherein said control unit selectively separates from the image forming element at least a part of the toner adsorbed to the image forming element;

a magnet formed to have a magnetic force smaller than a magnetic force that adsorbs the toner to the image forming element and disposed in the lengthwise direction of the image forming element and in a direction of a thickness of the substrate; and a magnetic insulating unit disposed longitudinally in relation to the image forming element and in a same line with each of the electrodes in a direction of a thickness of a magnetic force generation surface of the magnet with respect to the image forming element; and a toner return unit including a rotary sleeve passing between the image forming element and the image developing unit, wherein the rotary sleeve returns the toner separated from the image forming element by the image developing unit, to the toner supply unit.

13. The apparatus of claim 12, further comprising an auxiliary magnet formed to have a magnetic force smaller than a magnetic force that adsorbs the toner to the image forming element and disposed in the lengthwise direction of the image forming element to be disposed in a direction of a thickness of the control unit.

14. The apparatus of claim 12, wherein at least a part of the magnetic insulating unit is disposed within a containing groove formed in the magnet.

15. The apparatus of claim 12, wherein the magnetic insulating unit is formed of a magnetic insulating material and further disposed on the same line with each of the electrodes to be vertical to the magnet and separated such that the magnetic force of the magnet functions in an area corresponding to a gap between each of the electrodes of the control unit.

* * * * *